US005550428A

United States Patent [19]

Kume et al.

[11] Patent Number: 5,550,428

[45] Date of Patent: Aug. 27, 1996

[54] FRAME STRUCTURE OF APERTURE GRILLE WITH HIGHER LONG-SIDE FRAMES

[75] Inventors: Hisao Kume, Kanagawa; Yoshiro Horiuchi, Tokyo, both of Japan

[73] Assignee: Sony Corporation, Tokyo, Japan

[21] Appl. No.: 167,013

[22] Filed: Dec. 16, 1993

[30] Foreign Application Priority Data

Dec. 16, 1992 [JP] Japan ..... 4-336173

[51] Int. Cl.[6] ..... H01J 29/06; H01J 29/07

[52] U.S. Cl. ..... 313/407; 313/402; 313/348

[58] Field of Search ..... 313/403, 407, 313/408, 402, 404, 348; H01J 29/06, 29/07

[56] References Cited

U.S. PATENT DOCUMENTS

| | | | |
|---|---|---|---|
| 4,333,034 | 6/1982 | Ohgoshi | 313/407 |
| 4,495,437 | 1/1985 | Kume | 313/403 |
| 4,659,959 | 4/1987 | Fonda | 313/407 |
| 4,780,641 | 10/1988 | Hashiba | 313/269 |
| 5,214,349 | 5/1993 | Sakata | 313/407 |
| 5,308,723 | 5/1994 | Inoue et al. | 430/23 |
| 5,309,059 | 5/1994 | Kume et al. | 313/402 |

FOREIGN PATENT DOCUMENTS

| | | | |
|---|---|---|---|
| 0393488 | 10/1990 | European Pat. Off. | H01J 29/07 |
| 606066 | 6/1992 | Japan . | |
| 6131583 | 10/1992 | Japan . | |

*Primary Examiner*—Wendy Greening
*Assistant Examiner*—Andrew B. Christensen

[57] ABSTRACT

The present invention provides a color selecting mechanism for a cathode ray tube in which an enough area of an effective screen area of a color selecting electrode can be ensured. A frame (1) is constituted by a pair of opposite long-side frames (3) and a pair of opposite short-side frames (4). A color selecting electrode (2) is stretched over the upper surfaces (**3*b*) of the long-side frames (3). The frame (1) is formed by the integral molding. The end portions of the upper surfaces (3*b*) side of the long-side frames (3) are formed into a straight line as if they were cut down. The lower surfaces of connection portions between the long-side frames (3) and the short-side frames (4) are disposed on the same plane. The height of the long-side frames (3) from this plane is formed so as to be higher than the height of the short-side frames (4**).

6 Claims, 10 Drawing Sheets

FRAME STRUCTURE OF APERTURE GRILLE WITH HIGHER LONG-SIDE FRAMES

BACKGROUND OF THE INVENTION

1. Field of the Invention

The present invention relates to a color selecting mechanism for a cathode ray tube for use in a color television receiver, various display devices and so on, for example.

2. Description of the Prior Art

For example, a color selecting mechanism 42 called an aperture grill, as shown in FIG. 1, is known as a color selecting mechanism for a color cathode ray tube. This color selecting mechanism 42 is constructed in a manner that it has a frame 41 constituted by opposite support members (long-side portions) 41*a* and U-shaped elastic members (short-side portions) 41*b* provided between the end portions of the opposite support members 41*a*, and that a color selecting electrode 35 having a number of longitudinal stripe aperture portions 35*a* is stretched over the support members 41*a* of this frame 41. In the color selecting electrode (so-called grid structure) 35, a number of slit aperture portions 35*a* are arranged so as to be in parallel to each other so that a slender stripe grid element 35*b* is formed between each pair of adjacent ones of the aperture portions 35*a*.

It is preferable that the ratio $I_1/I_2$ of the sectional secondary moment $I_1$ of the support members 41*a* of the frame 41 in the tension direction of the grid elements 35*b*, that is, in the direction to give turnbuckle, to the sectional secondary moment I2 of the elastic members 41*b* in the same manner, is selected to be 1.5 to 2.0, more preferably 1.70 to 1.80 (see Japanese published patent publication No. 61-31583).

On the other hand, such an integrated type color selecting mechanism 30 as shown, for example, in FIG. 2 has been proposed in order to reduce a strain at the time of working to thereby increase the accuracy of the dimension, and in order to simplify the working process.

As shown in FIG. 2, this color selecting mechanism 30 is molded integrally by use of the same material so that a rectangular frame 33 is constituted by long-side portions 31 and short-side portions 32.

Both of the long-side frames 31 and the short-side frames 32 are formed so as to be L-shaped in section, and their upper surfaces 31*a* and 32*a* are substantially in the same plane. Further, connection portions 34 between the long-side frames 31 and the short-side frames 32 respectively have curvature portions depending on the thickness of the frame 33, and cut portions 32*b* are formed in the respective short-side frames 32 so as to ensure the elasticity when the color selecting electrode 35 is to be attached. Then, the color selecting electrode 35 having a number of longitudinal stripe aperture portions 35*a* is stretched over the upper surface of the frame 33 (see Japanese published patent publication No. 60-6066).

However, in the case of such a conventional example, since the respective upper surfaces 31*a* and 32*a* of the long-side frames 31 and the short-side frames 32 are substantially on the same plane as shown in FIG. 2, it is necessary for the connection portions 34 between the long-side frames 31 and the short-side frames 32 to have a certain curvature depending on the thickness of the frame 33.

On the other hand, since the color selecting electrode 35 is attached, by welding, to the upper surfaces 31*a* of the long-side frames 31, there has been a disadvantage that the longitudinal dimension of the color selecting electrode 35 is limited so that it is impossible to ensure an enough area for a so-called effective screen.

OBJECTS AND SUMMARY OF THE INVENTION

Therefore, it is an object of the present invention to provide an improved color selecting mechanism for a cathode ray tube in which the aforesaid shortcomings and disadvantages encountered with the prior art can be eliminated.

More specifically, it is an object of the present invention to provide a color selecting mechanism for a cathode ray tube in which an enough effective screen area of a color selecting electrode can be maintained.

It is another object of the present invention to provide a color selecting mechanism for a cathode ray tube in which accuracy of the dimension can be improved.

According to an aspect of the present invention, there is provided a color selecting mechanism for a cathode ray tube which comprises a rectangular frame constituted by a pair of opposite long-side frames and a pair of opposite short-side frames, and a color selecting electrode having longitudinal stripe aperture portions and stretched over the pair of opposite long-side frames facing the fluorescent screen of a panel on upper surface sides thereof, wherein end portions on the upper surface side of each of the long-side frames are formed into a straight line, lower surfaces of connection portions between the long-side frames and the short-side frames are disposed on the same plane, and the height of each of the long-side frames from the plane is made to be higher than that of each of the short-side frames.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Embodiments of the color selecting mechanism for a cathode ray tube according to the present invention will be described with reference to FIGS. 3 to 13.

Figure 3:
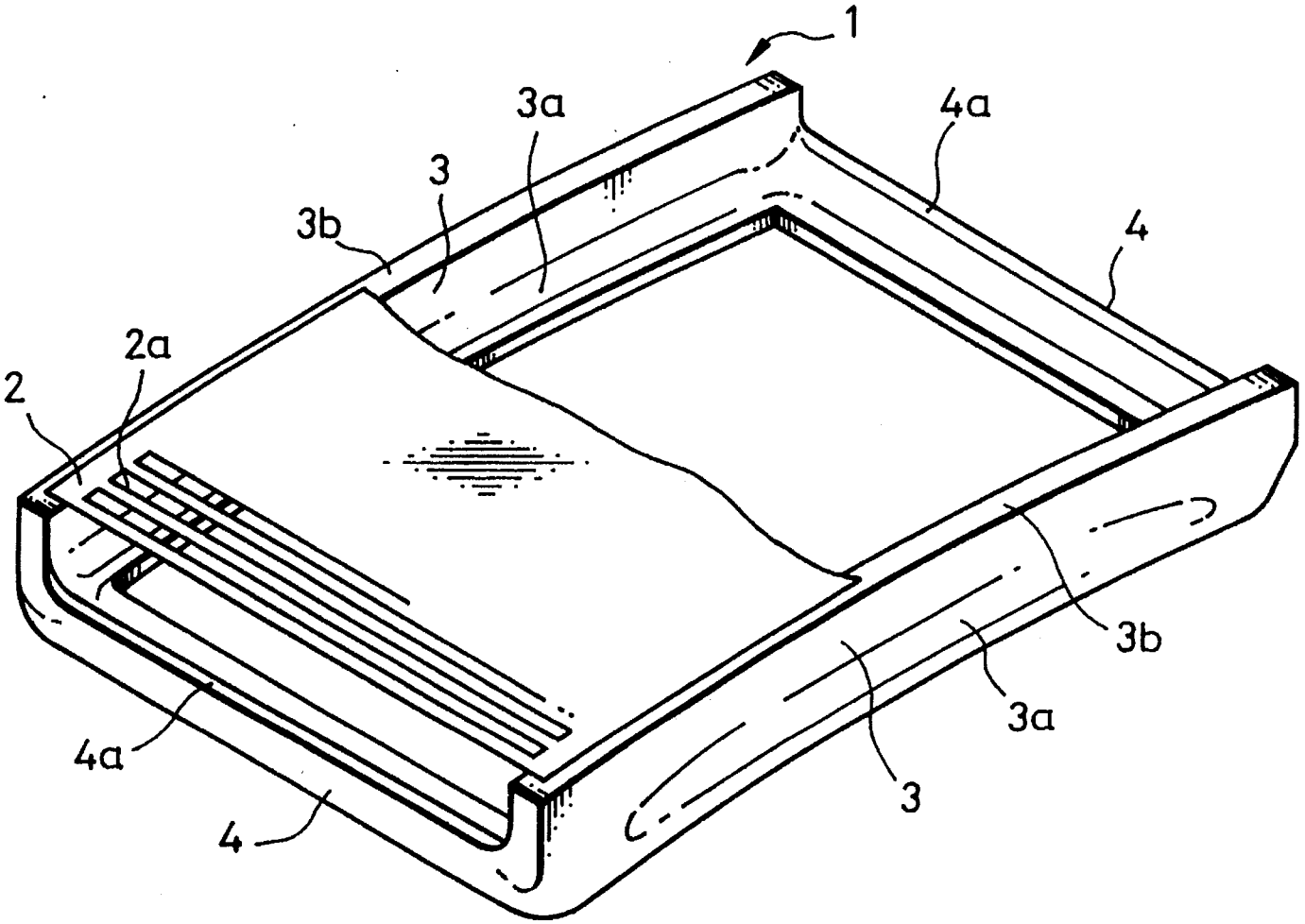
FIG. 3 is a perspective view showing a color selecting mechanism for a cathode ray tube according to a first embodiment of the present invention.

FIG. 3 is a perspective view illustrating a color selecting mechanism for a cathode ray tube according to a first embodiment of the present invention.

As shown in FIG. 3, the color selecting mechanism of this embodiment is constituted by an integrated frame 1 formed in a manner which will be described later, and a color selecting electrode 2 to be attached to the frame 1.

Figure 4:
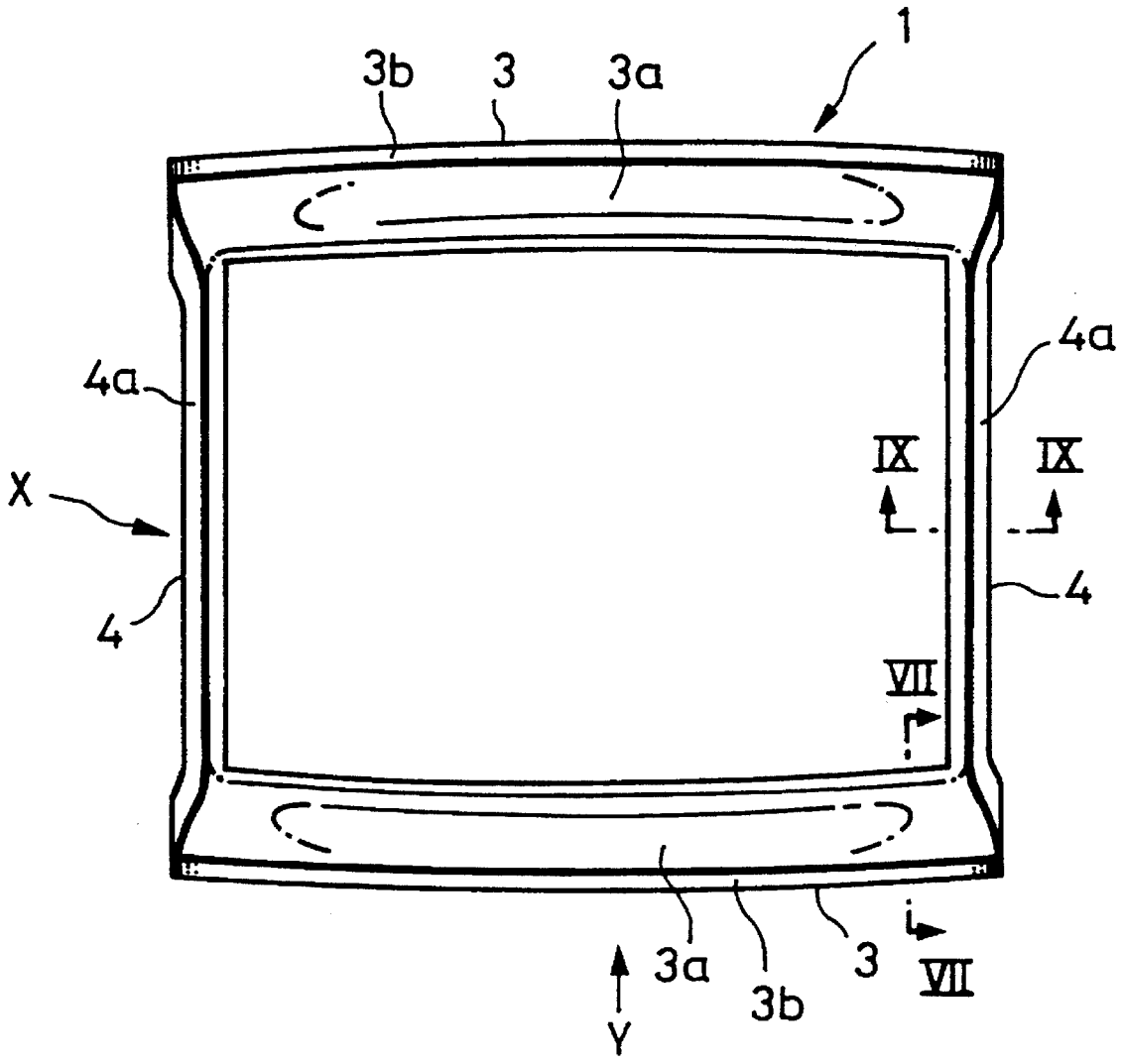
FIG. 4 is a top plan view of a frame used in the first embodiment of the present invention.
Figure 5:
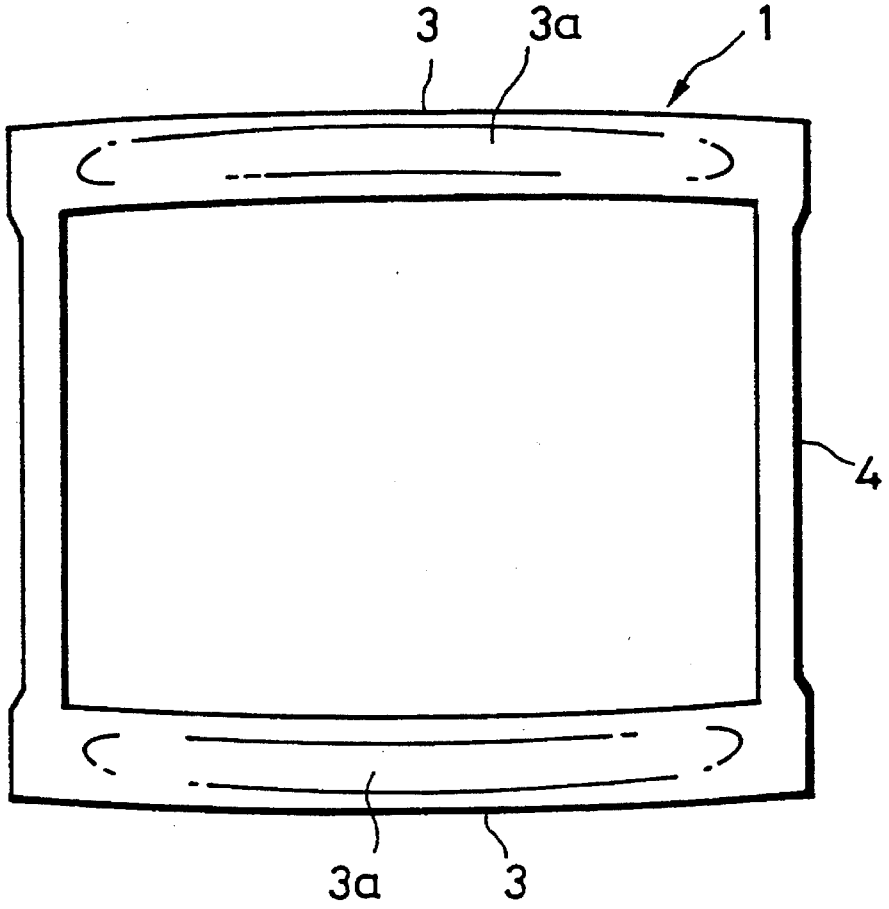
FIG. 5 is a plan view showing the frame of the first embodiment from the lower surface side.

This frame 1 is made of, for example, a stainless steel, and is constituted so as to be substantially in a rectangular shape by long-side frames (corresponding to support members) 3 and short-side frames (corresponding to elastic members) 4, as shown in FIGS. 4 and 5.

Figure 6:
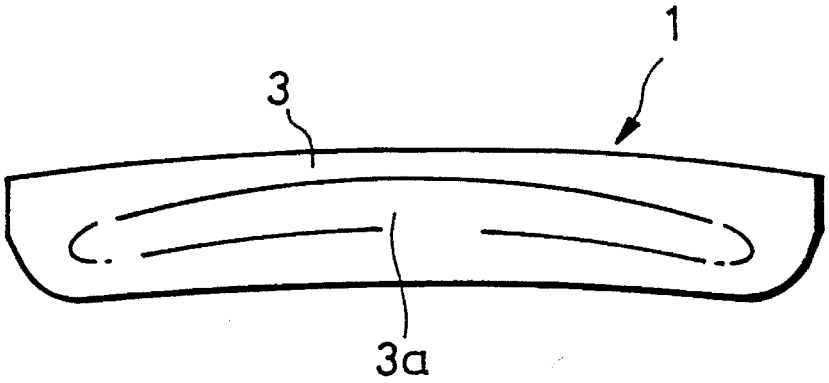
FIG. 6 is a diagram showing the frame of the first embodiment from the arrow Y direction in FIG. 4.
Figure 7:
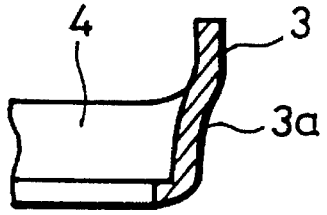
FIG. 7 is a cross-sectional view taken along the line VII—VII in FIG. 4.

The long-side frames 3 each have a shape of a bow plate, and are substantially L-shaped in section, as shown in FIGS. 6 and 7. Further, a step portion 3*a* is formed substantially all over the area of each long-side frame 3. This step portion 3*a* is formed to project toward the inside of the frame 1 and serves to reinforce each of the long-side frames 3.

Figure 8:
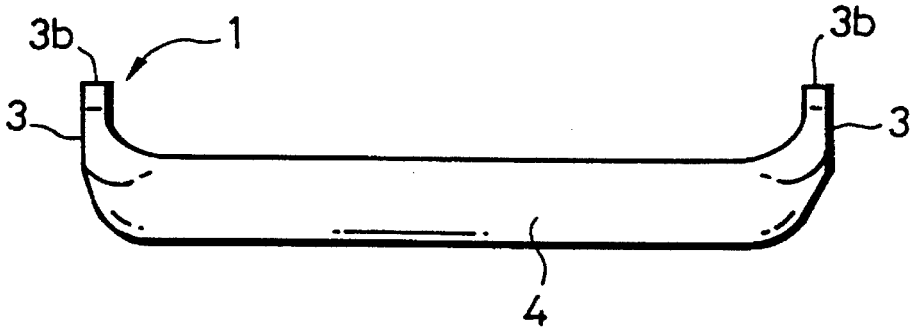
FIG. 8 is a diagram showing the frame of the first embodiment from the arrow X direction in FIG. 4.
Figure 9:
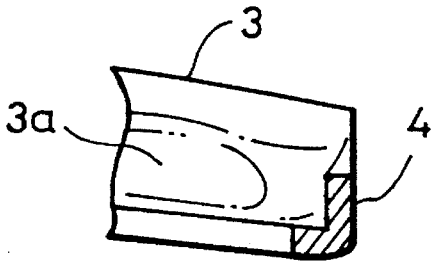
FIG. 9 is a cross-sectional view taken along the line IX—IX in FIG. 4.

On the other hand, the short-side frames 4 each are formed into a straight line, as shown in FIG. 8. Each of the short-side frames 4 has an L-shaped section, as shown in FIG. 9.

In this embodiment, the lower surfaces (surfaces on an electron gun side) of the connection portions between the long-side frames 3 and the short-side frames 4, i.e., the respective corner portions of the frame 1, are formed on the same plane, as shown in FIGS. 5, 6 and 8.

On the other hand, as to the upper surface of the frame 1, that is, the surface on which the color selecting electrode 2 is to be attached, there is provided a difference in height between the long-side frames 3 and the short-side frames 4 as shown in FIGS. 3 through 8, unlike the conventional example. That is, the frame 1 is formed so that the height of the upper surfaces 4*a* of the short-side frames 4 is lower than the height of the upper surfaces 3*b* of the long-side frames 3. That is, on the upper surface side of the frame 1, both ends of the long-side frames 3 at the respective corner portions are formed into a straight line, that is, a sharp edge configuration, as if they are cut down.

As the color selecting electrode 2 used in this embodiment, a known one similar to the above-mentioned color selecting electrode 35 is employed. That is, the color selecting electrode 2 is made by a thin plate, for example, which is made of extremely low carbon steel, and which has a number of longitudinal stripe aperture portions 2*a* for transmitting electron beams therethrough. This color selecting electrode 2 is fixed by welding so that it is stretched over the upper surfaces 3*a* of the long-side frames 3 by a predetermined pressure.

Figure 1:
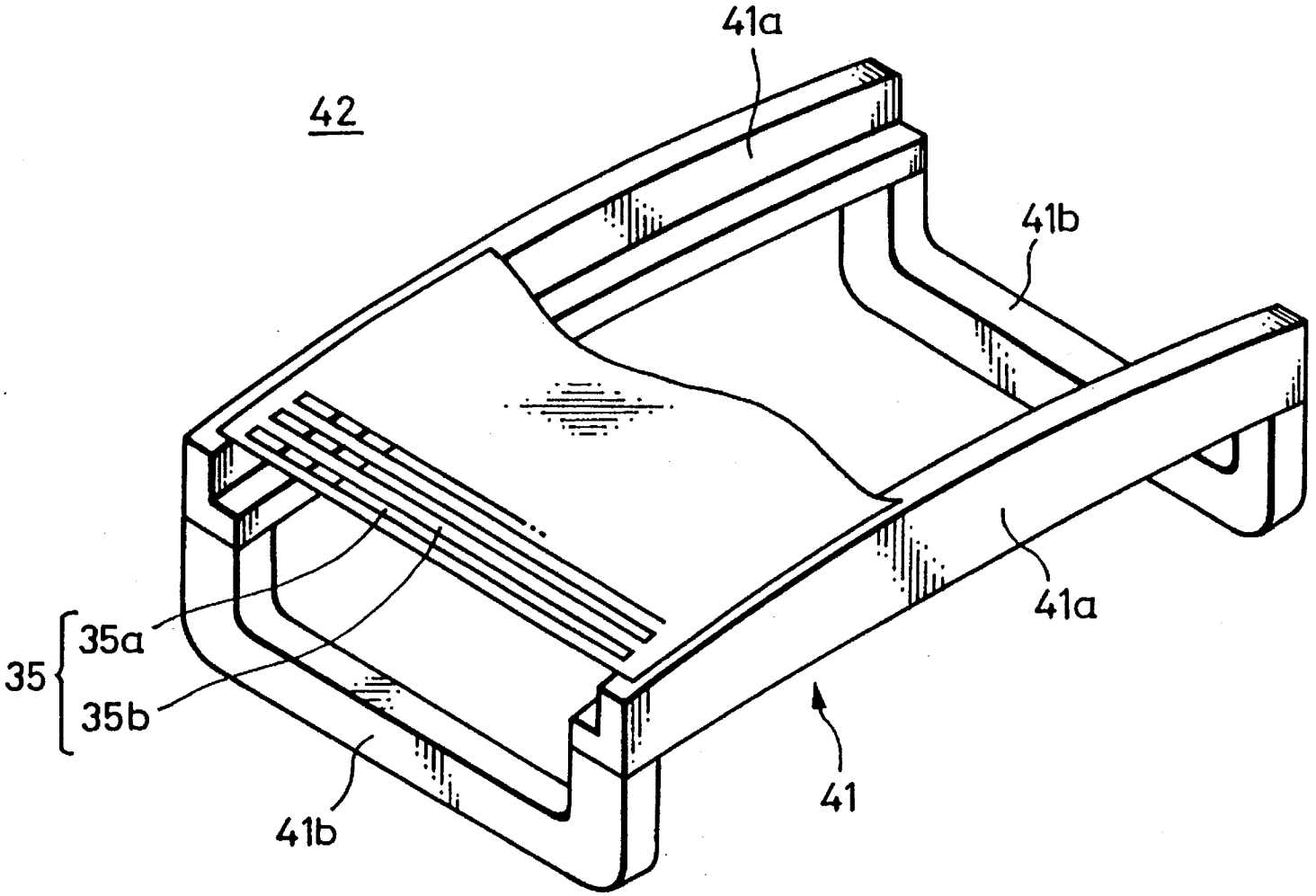
FIG. 1 (PRIOR ART)
FIG. 1 is a perspective view illustrating an example of a conventional color selecting mechanism for a color cathode ray tube.
Figure 2:
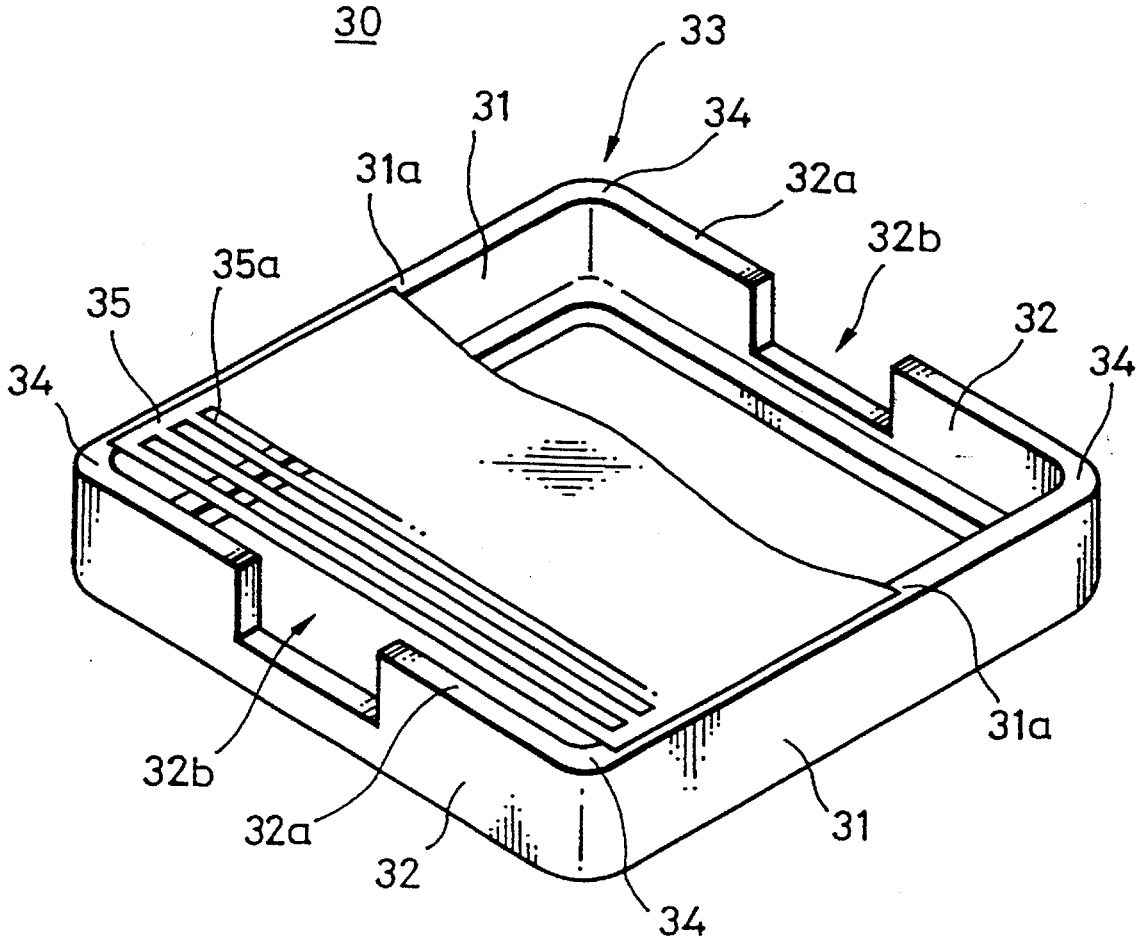
FIG. 2 (PRIOR ART)
FIG. 2 is a perspective view illustrating another example of the conventional color selecting mechanism for a color cathode ray tube.

In the integrated frame 1 in this embodiment, since the lower surfaces of the respective corner portions of the frame are on the same plane that is different from that of the above-mentioned frame 41 shown in FIG. 1, it is impossible to ensure strength by providing a bow structure by use of the short-side frames 4.

Figure 10A:
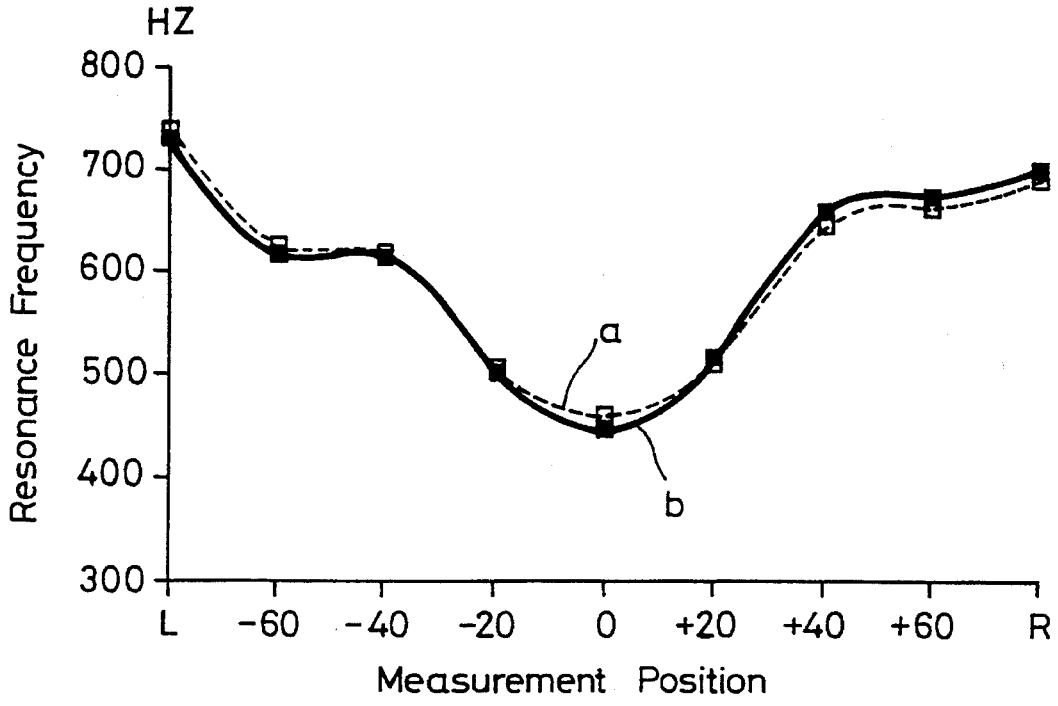
FIG. 10A is a graph showing measured results of tension of the color selecting electrode obtained before a blackening treatment is carried out.
Figure 10B:
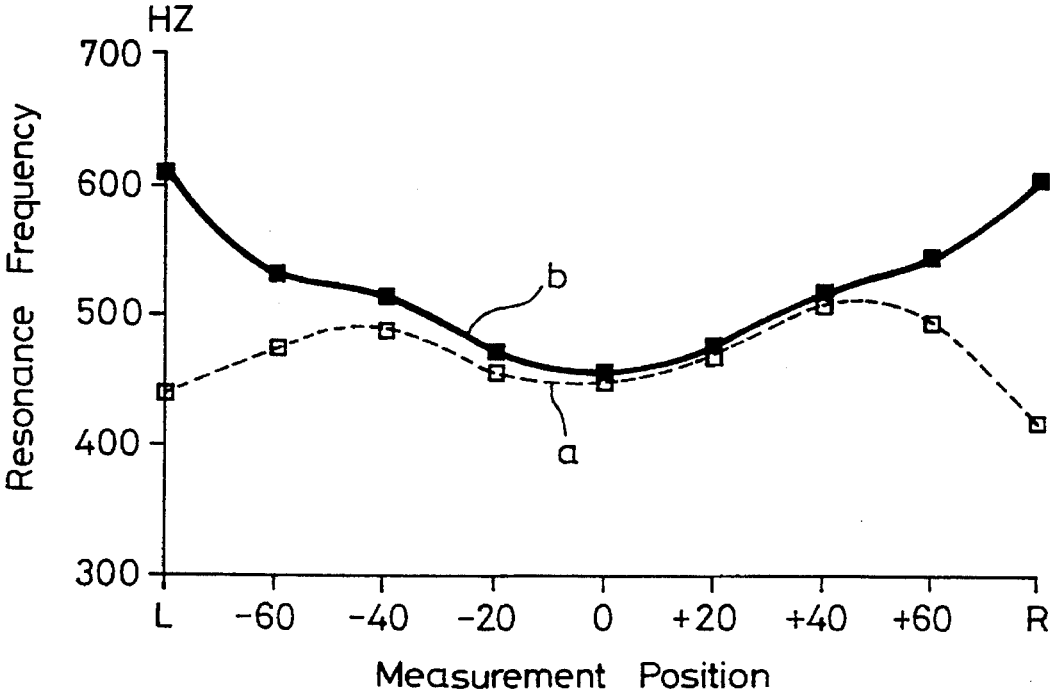
FIG. 10B is a graph showing measured results of tension of the color selecting electrode obtained after the blackening treatment was carried out.

Although a blackening stabilizing treatment (such as quenching and tempering, or the like ) is usually performed after the color selecting mechanism was assembled, it is necessary to take into consideration the respective linear expansion coefficients of the color selecting electrode 2 and the frame 1 since this treatment may deteriorate the tension of the color selecting electrode 2, as shown in FIGS. 10A, 10B. FIGS. 10A and 10B show, as the results on a 10-inch size of the color selecting mechanism, the resonance frequency corresponding to the tension at each measuring point. FIG. 10A shows the results before the blackening stabilizing treatment, and FIG. 10B shows the results after the blackening stabilizing treatment. In FIGS. 10A and 10B, open squares on each curve a plot measured results obtained when an SCM415 of Cr—Mn—Mo steel was used as the frame material, and solid squares on each curve b plot measured results obtained when an SUS430 was used as the frame material, respectively.

In this embodiment, in view of the foregoing circumstances, the difference between linear expansion coefficients of the color selecting electrode 2 and the frame 1 is selected so as not to be larger than $2.0\times10^{-6}$/°C. That is, if the linear expansion coefficient $\alpha_1$ of the color selecting electrode 2 is selected to be about $\alpha_1=10\times10^{-6}$ /°C., then it is preferable that the linear expansion coefficient $\alpha_2$ of the frame 1 is selected to be $\alpha_2=12.0\times10^{-6}$/°C. With this arrangement, it is possible to suppress the strain due to a heat to a small value to thereby make it possible to improve the accuracy of the dimension of the color selecting mechanism.

A method of producing the frame 1 in this embodiment will be described next.

Figure 11:
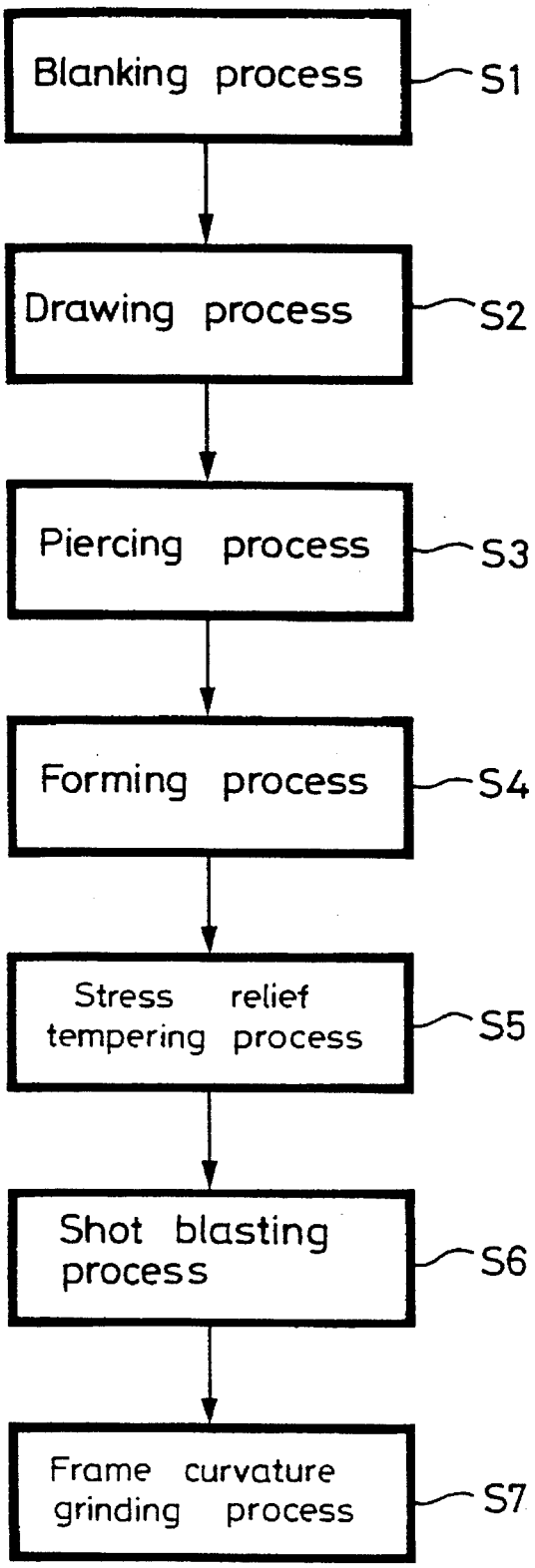
FIG. 11 is a flowchart showing a frame manufacturing process.

Initially, as shown in FIG. 11, in a blanking process, the outer frame of the frame 1 is punched out from a sheet steel plate of a predetermined thickness sheared into a shape of the development of the frame 1, and holes for positioning relative to a metal mold are punched out (process S1).

In the next drawing process (S2), this sheet steel plate is reduced.

Then, in a piercing process (S3), the inner frame is punched to make up an effective screen area.

Further, in a forming process (S4), the molding is performed by reducing and pressing.

Subsequently, the frame 1 is completed by performing a stress relief tempering process (S5), a shot blasting process (S6), and a frame curvature grinding process (S7). The long-side frames 3 and the short-side frames 4 are made to have the same plate thickness in this frame 1.

In this embodiment having such a configuration, the end portions on the upper surface side of the long-side frames 3 to which the color selecting electrode 2 is to be attached are formed into a straight line, and at the same time the height of the upper surfaces 4*a* of the short-side frames 4 which are connected to the opposite end portions of the long-side frames 3 is made lower than the height of the upper surfaces 3*b* of the long-side frames 3. It is therefore possible to form the aperture portions 2*a* up to the marginal portions of the color selecting electrode 2 to thereby make it possible to ensure an enough effective screen area particularly in the direction perpendicular to the aperture portions 2*a*.

Further, such a structure can give an enough function as elastic members to the short-side frames 4.

Although it is preferable to make the sectional shapes of the long-side and short-side frames as an L-shape in section as shown in FIGS. 7 and 9, the sectional secondary moments of those frames may be established individually and freely to a variety of desired values, so that it is possible to optimize the structure of the frame.

Further, since a remaining material after punching out the inside portion is in vain in such an integrated frame in the above-mentioned embodiment, a smaller frame may be produced by use of such a remaining material.

Figure 12:
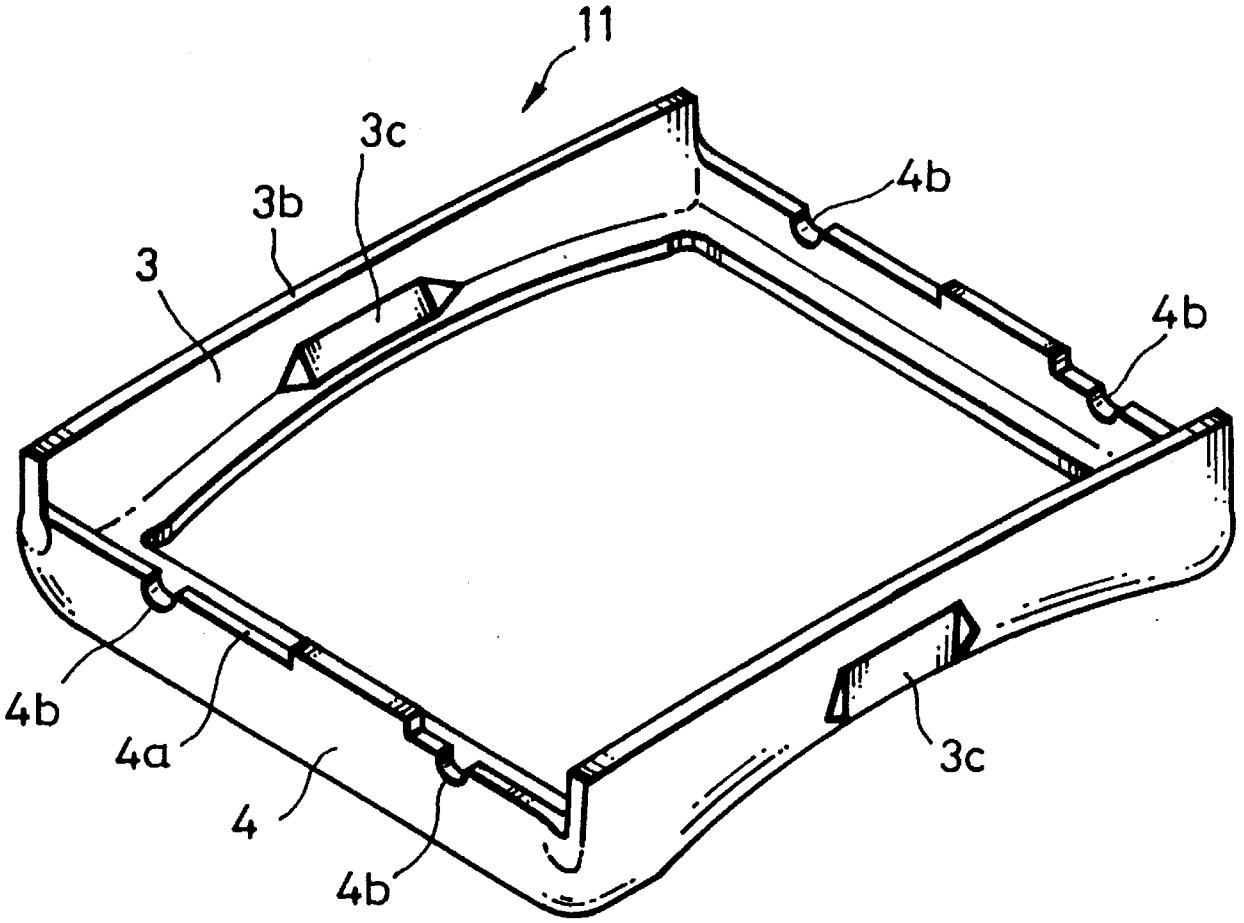
FIG. 12 is a perspective view showing the color selecting electrode for a cathode ray tube according to a second embodiment of the present invention.

FIG. 12 shows a main portion of a second embodiment of the present invention which shows another example of the frame. In this frame 11, a cut portion 4*b* for obtaining a required spring constant is formed in each of the short-side frames 4 to which the color selecting electrode 2 is not attached. A reinforcing step portion 3C is formed in the center portion of each of the long-side frames 3. The other configuration and operation are the same as those of the first embodiment and therefore need not be described herein.

Figure 13:
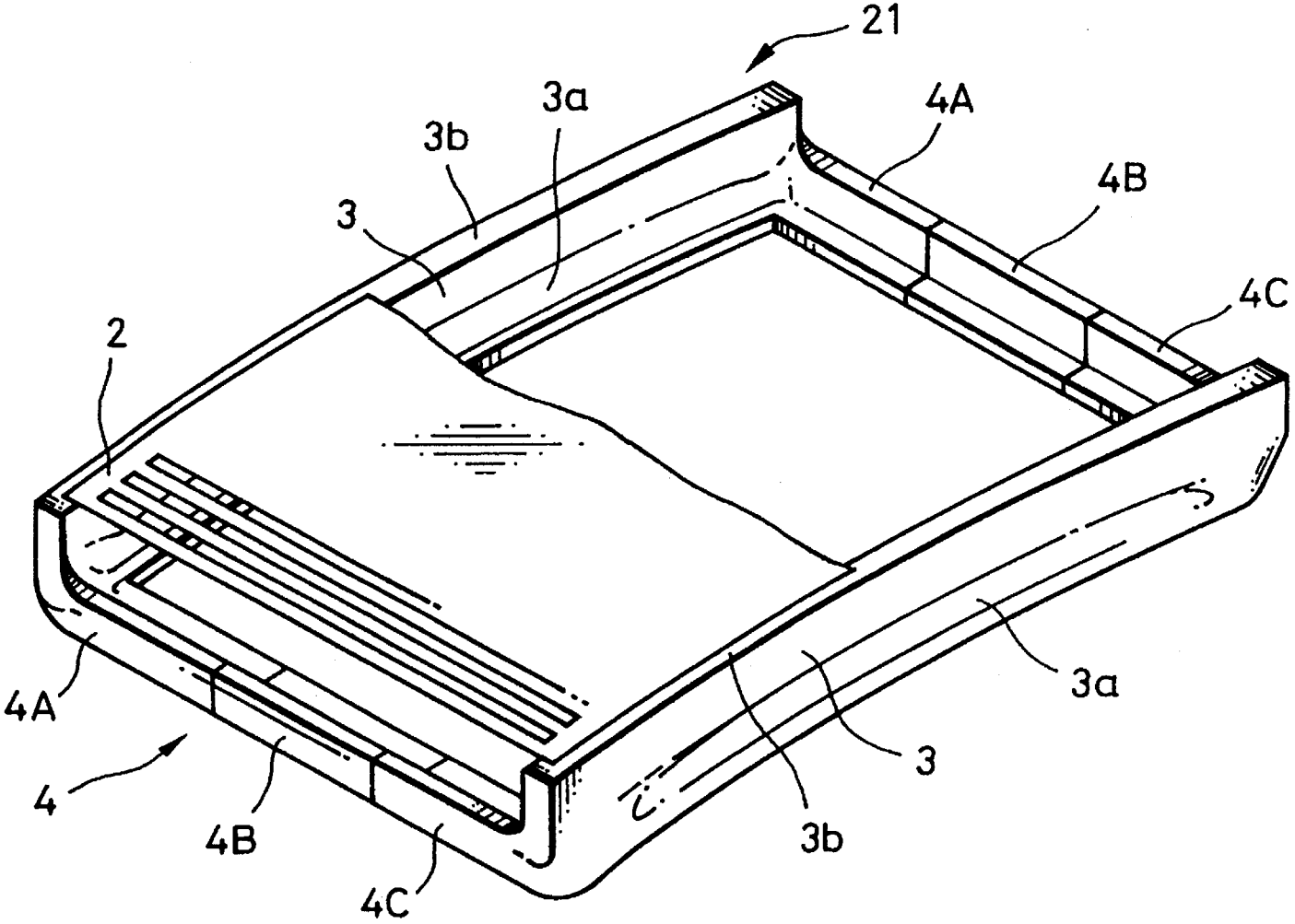
FIG. 13 is a perspective view showing the color selecting electrode for a cathode ray tube according to a third embodiment of the present invention.

FIG. 13 shows a main portion of a third embodiment of the present invention which shows a further example of the frame. As shown in FIG. 13, in this frame 21, the short-side frames 4 are divided. Members 4A, 4B and 4C constituting each of the short-side frames 4 are fixed by welding.

In this case, the shape of the completed frame 21 is the same as that of the first embodiment, but more or less modification may be performed so long as they are within the scope of the present invention. For example, the member 4B and each of the long-side frames 3 including the other members 4A and 4C may be formed of the same plate material or may be formed of different plate materials. Since the other configuration and operation thereof are the same as those of the first embodiment, the description thereof is omitted herein.

As described above, according to the present invention, the end portions on the upper surface side of the long-side frames are formed into a straight line, and the height of the long-side frames from the lower surfaces of connection portions between the long-side and short-side frames which are disposed on the same plane is formed higher than the height of the short-side frames. Accordingly, it is possible to form the aperture portions up to the marginal portions of the color selecting electrode. As a consequence, the area of the effective picture screen can be ensured sufficiently.

Moreover, if the frame is constituted by the same member and the difference between linear expansion coefficient of the material of the frame and the material of the color selecting electrode is made not to be larger than $2.0\times10^{-6}$/°C., then it is possible to suppress the strain due to heat to a small value to thereby make it possible to improve the accuracy of the dimension of the color selection mechanism.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A color selecting mechanism for a cathode ray tube, comprising:

a rectangular frame constituted by a pair of opposite long-side frames and a pair of opposite short-side frames; and a color selecting electrode having longitudinal stripe aperture portions and stretched over said pair of opposite long-side frames facing the fluorescent screen of a panel on upper surface sides thereof, wherein end portions on the upper surface side of each of said long-side frames are formed into a straight line spaced above said short-side frames, the lower surfaces of said long-side frames and the lower surfaces of said short-side frames defining a lower surface which is substantially evenly spaced from a surface defined by the upper surfaces of said long-side frames, and the height of each of said long-side frames from said lower surface is made to be higher than that of each of said short-side frames.

2. A color selecting mechanism for a cathode ray tube according to claim 1, wherein said long-side frames and said short-side frames are formed of the same material.

3. A color selecting mechanism for a cathode ray tube according to claim 2, wherein the difference between a linear expansion coefficient of the material of said frame and a linear expansion coefficient of the material of said color selecting electrode is made so as not to be larger than $2.0\times10^{-6}$/°C.

4. A color selecting mechanism according to claim 1, wherein at least said long-side frames have an L-shaped cross-section and are formed by being punched from sheet metal.

5. A color selecting mechanism according to claim 1, wherein said color selecting electrode extends to approximately an end portion of at least one of said long-side frames.

6. A color selecting mechanism for a cathode ray tube, comprising:

a rectangular frame constituted by a pair of opposite long-side frames and a pair of opposite short-side frames each of said frames having an L shaped cross-section; and a color selecting electrode having longitudinal stripe aperture portions and stretched over said pair of opposite long-side frames facing the fluorescent screen of a panel on upper surface sides thereof, wherein end portions on the upper surface side of each of said long-side frames are formed into a straight line, lower surfaces of connection portions between said long-side frames and said short-side frames are disposed in the same plane, and the height of each of said long-side frames from said plane is made to be higher than that of each of said short-side frames.

* * * * *